United States Patent [19]

Schonberger

[11] 4,236,298

[45] Dec. 2, 1980

[54] METHOD OF TRIMMING THERMISTOR OR OTHER ELECTRICAL COMPONENTS AND THE CONTACTS THEREOF

[76] Inventor: Milton Schonberger, 195 Fern St., Westwood, N.J. 07675

[21] Appl. No.: 6,362

[22] Filed: Jan. 25, 1979

Related U.S. Application Data

[63] Continuation-in-part of Ser. No. 879,193, Feb. 21, 1978, abandoned.

[51] Int. Cl.[3] ..... H01C 17/22

[52] U.S. Cl. ..... 29/610R; 29/612; 29/621; 338/195

[58] Field of Search ..... 29/610, 612, 613, 620, 29/621; 338/195

[56] References Cited

U.S. PATENT DOCUMENTS

| | | | |
|---|---|---|---|
| 3,535,778 | 10/1970 | Falanga | 29/610 |
| 3,768,157 | 10/1973 | Buie | 29/613 |
| 3,827,142 | 8/1974 | Bennett | 29/613 |

FOREIGN PATENT DOCUMENTS

| | | |
|---|---|---|
| 807728 | 1/1959 | United Kingdom . |
| 1073748 | 6/1967 | United Kingdom . |
| 1087688 | 10/1967 | United Kingdom . |
| 1280610 | 5/1972 | United Kingdom . |

*Primary Examiner*—Francis S. Husar
*Assistant Examiner*—Gene P. Crosby
*Attorney, Agent, or Firm*—Ostrolenk, Faber, Gerb & Soffen

[57] ABSTRACT

A thermistor or other electrical component has electric contact material applied on at least one surface; the surface having the contact material is positioned over the surface of a supporting substrate; the substrate may carry two conductors to which the contact material on the component should be electrically connected; in one embodiment of the invention, a gap is formed to extend through the substrate through which gap an abrading element may extend for abrading the contact material, thereby to form two contacts from the unitary layer of contact material and also to shape the resulting contacts; alternatively the layer of contact material may be removed by a laser beam projected through the gap; in a further embodiment, there is no gap in the substrate; instead the substrate is clear and transparent beneath the contact material; a laser beam is shone through the substrate and acts upon and removes some of the contact material.

23 Claims, 5 Drawing Figures

METHOD OF TRIMMING THERMISTOR OR OTHER ELECTRICAL COMPONENTS AND THE CONTACTS THEREOF

CROSS REFERENCE TO RELATED APPLICATION

This is a continuation-in-part application of U.S. patent application Ser. No. 879,193 filed Feb. 21, 1978, now abandoned.

BACKGROUND OF THE INVENTION

The invention relates to thermistors, or the like electrical components and particularly to a method of defining and/or trimming the contacts of a thermistor, or the like electrical component and even of trimming the thermistor or electrical component itself.

This description will hereafter refer only to a thermistor. However, as will be apparent to persons skilled in the art, other electrical components, such as resistors, capacitors, or the like, are adapted to application of the method of the invention thereto.

The invention is particularly useful in connection with forming and/or trimming thermistor contacts according to the teachings of U.S. application Ser. No. 787,422, filed Apr. 14, 1977, entitled "Method of Adjusting Resistance of a Thermistor". Additionally, the invention may be used to form the thermistor contacts for the thermometer apparatus disclosed in certain embodiments in U.S. application Ser. No. 779,152, filed Mar. 18, 1977, entitled "Fever Thermometer, or the Like Sensor". Both of these applications are incorporated herein by reference for their teachings with respect to the formation and use of thermistors and for all other teachings and disclosures contained therein.

A thermistor is a semiconductor usually of a ceramic like material and comprised of a metallic oxide. Typically, the ceramic thermistor body is formed of a sintered mixture of manganese oxide, nickel oxide, ferric oxide, magnesium chromate or zinc chromate, or the like. A thermistor makes use of the resistive properties of semiconductors. Thermistors have a large negative temperature coefficient of resistivity such that as temperature increases, the resistance of the thermistor decreases.

A thermistor is connected into an electric circuit which utilizes the resistance of the thermistor in some manner. For effecting an electric connection to the thermistor, the thermistor has contacts attached to it.

The ceramic bodies of thermistors are formed in many ways. One typical thermistor is in a wafer form and is multi-sided. The wafer usually is six sided and has two large opposite surfaces and four narrower width peripheral sides defining the large opposite surfaces. A wafer thermistor may, for example, be cut from a larger sheet or other body of thermistor material or it may be molded. The ceramic material of the thermistor may be formed or cut in virtually any size. Various techniques for cutting, grinding or otherwise trimming thermistor bodies to a particular size are well known.

The wafer type of thermistor has electric contacts secured directly to the surface of the semiconductor material of the thermistor. Typically, the thermistor contacts are comprised of metal and may be comprised of silver mixed with glass particles called "frit." The contacts are baked or heat fused on to flat surfaces of the thermistor semiconductor material. Preferably, the attached contact material covers the entirety of any surface of the thermistor to which it is applied, although the material can cover any area less than the entirety of any surface. Depending upon the particular use and application of the thermistor, its contacts are defined on one surface thereof or on different surfaces thereof.

An entire thermistor may be quite small, and a typical thermistor adapted for use in the aforesaid U.S. applications Ser. Nos. 779,152 and 787,422 is a generally six-sided wafer, whose large surfaces are generally squares and whose longest dimension is on the order of 0.060". Forming the contacts on such a small thermistor from contact material by trimming the contact material, or trimming the contact material on the thermistor itself for any other reason, can be very delicate operations requiring very fine movements. It can be quite time consuming and/or require quite expensive instrumentation.

In the thermometer of U.S. application Ser. No. 779,152, the thermistor contacts are each placed in electrical contact with electrical conductors. The thermistor is quite small in size. The conductors are also quite thin and small. Precise emplacement and orientation of the thermistor contacts on the conductors can be quite difficult. If the thermistor has two contacts on one surface of the thermistor, for example, and each contact is to be seated on only one of the two conductors, then if the tiny thermistor is twisted slightly from its correct orientation, one of its contacts may undesirably bridge both of the conductors, thereby short circuiting the thermistor and rendering inoperative any apparatus, such as a thermometer, with which the thermistor is used.

Using expensive instrumentation and/or expending considerable time and effort, an operator can properly define and/or trim the contacts of an even quite small sized thermistor and he can properly emplace such a thermistor on conductors. However, reduction in the amount of time and effort required and elimination of the need for expensive mounting and trimming equipment would be desired.

SUMMARY OF THE INVENTION

Accordingly, it is the primary object of the invention to enable a thermistor, or an electrical component provided with like electric contacts, to have its contacts easily yet properly formed and/or trimmed and to also trim the thermistor or electric component itself, as required.

It is another object of the invention to eliminate the need for considerable precision in applying a thermistor or electric component, and particularly its contacts, to conductors that are to be connected with the thermistor or electric component and to instead enable the thermistor or component to be placed at various somewhat imprecise positions without adversely affecting thermistor or component performance.

It is a further object of the invention to provide an improved method for forming and/or trimming the contacts of a thermistor or other electric component.

It is a further object of the invention to easily form thermistor contacts from applied contact material.

A thermistor has contact material applied on at least one surface thereof. Two of the contacts of the thermistor are to be defined on a surface carrying the contact material by removal of some of the contact material so as to define a groove or gap in the contact material, which serves as the gap between the two thermistor contacts. Alternatively, according to U.S. application Ser. No. 787,422, one of the contacts of the thermistor may have to be trimmed for changing the resistance of the thermistor. Finally, part of the thermistor material itself may have to be removed. Perhaps other treatments will be given to the thermistor.

According to the method of the invention, the surface of the thermistor carrying the contact material to be abraded, removed or otherwise treated or the thermistor surface itself is positioned above a surface of a supporting substrate. In one arrangement, that surface of the substrate supports two conductors, as shown, for example, in U.S. application Ser. No. 779,152. The contact material is preferably seated on the substrate and in the situation where there are conductors on the substrate, the contact material is seated on the conductors. In one arrangement involving placing the layer of contact material on the conductors, the contact material has not yet been trimmed or formed to define contacts thereon. Therefore, precise placement of the thermistor and the contact material on the substrate and on the conductors thereon is not critical, so long as the contact material is in engagement with both of the conductors.

The thermistor is secured to the substrate so that it will not shift with respect to the substrate or with respect to the conductors on the substrate.

A first embodiment is now described. Preferably before, but possibly after, the thermistor is applied to the substrate, a gap or opening is defined in and through the substrate providing access through the substrate to the thermistor and to the layer of contact material. The gap is of a length to extend beyond the edges of the facing surface of the thermistor. The gap may extend out to the edge of the substrate or it may be inside the peripheral margin of the substrate, which strengthens the substrate. The shape and the various dimensions of the gap are not critical, so long as the gap is shaped to permit an abrading or trimming means or other contact material or thermistor material removing or treating means to pass through the gap from the other side of the substrate toward the thermistor surface to be treated and so long as a line or path of abrasion, trimming, removal or other treatment can be produced by the means which passes or extends through the gap.

The foregoing is of particular importance in connection with defining a pair of contacts from a single layer of contact material on one surface of a thermistor. The thermistor shown in both of U.S. applications Ser. Nos. 779,152 and 787,422 is quite small in size. It is quite difficult to precisely place such a wafer thermistor to ensure that contacts preformed on one of its small size surface will each contact but one of the two conductors on the substrate and to ensure that the thermistor will not be incorrectly oriented so that one of the thermistor contacts inadvertently extends into engagement with both of the conductors. According to the invention, the surface of the thermistor carrying the untreated layer of contact material is simply placed over and secured to the conductors, and the placement of the thermistor is sufficient so long as the as yet untreated layer of contact material merely engages both of the conductors simultaneously. A gap in the substrate either previously has been formed or is now formed to extend through the substrate between the two conductors. The gap is of a length sufficient for the gap to extend beyond the edges of the thermistor. With the thermistor secured in place, an appropriate abrading means, such as an abrasive file, burr, disc or the like, or even a beam of laser light is directed to pass through the gap and is operated to remove a portion of the contact material from the surface of the thermistor overlying the gap in the substrate. This creates a gap in the layer of contact material and such gap defines two contacts in the single large layer of contact material. It is apparent that no matter how the thermistor was first oriented on the conductors, the resulting contacts produced by the foregoing method will each be in engagement with only one respective conductor on the substrate and will not undesirably inadvertently contact both conductors.

In a modified embodiment of the invention, no gap is required in the substrate. The substrate itself, particularly at the section where the thermistor is to be secured in place, is comprised of material that is capable of transmitting through itself electromagnetic radiation of at least a particular wavelength, i.e. the wavelength of radiation emitted by a laser light source to be used for the trimming. In a more specific embodiment, the substrate section is comprised of a very light transmissive, e.g. clear and transparent, material. Now, that same beam of laser light that in the first embodiment is shone through the gap in the substrate may instead be shone through the light transmissive substrate, and upon striking the contact material between the conductors, the laser light will burn the contact material away. All other benefits and features of the first described embodiment, both heretofore and hereafter described, can be achieved with the modified embodiment.

It is apparent that appropriate placement of the thermistor and of the gap and the proper locating of the striking path of the laser beam on the contact material will also enable a thermistor contact to be trimmed according to the present invention in order to change the thermistor rating, for the reasons discussed in U.S. aplication Ser. No. 787,422. It is also possible to remove a whole section of thermistor material through a means for acting upon the body of the thermistor extending or passing through the gap in the substrate or through laser light shining through the substrate.

Other objects and features of the invention will become apparent from the following detailed description taken in conjunction with the accompanying drawings.

BRIEF DESCRITPION OF THE DRAWINGS

DESCRIPTION OF A PREFERRED EMBODIMENT

Figure 1:
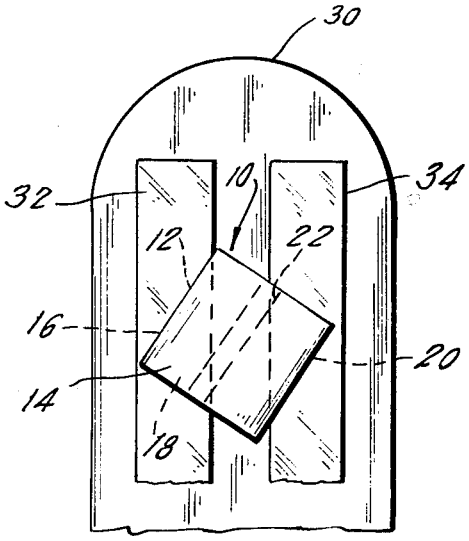
FIG. 1. PRIOR ART
FIG. 1 is a top plan view of a thermistor on conductors and a substrate as might be present in the prior art.

FIG. 1 is labeled Prior Art, but it does not, in fact, show the state of the art. Instead, FIG. 1 demonstrates a situation for which the invention provides an improvement. FIG. 1 shows the theremistor 10, which is comprised of a wafer of semiconductor material 12, and as can be seen from FIG. 3, a layer of electric contact material 14 at the top surface of the wafer 12 and a layer 16 of contact material at the bottom surface of the wafer 12. The wafer of semiconductor material is quite small, and it generally is square on its large surface, with each side having a length on the order of 0.060".

The thermistor 10 in FIG. 1 was preformed prior to being installed on the substrate 30 illustrated in FIG. 1. In particular, therefore, the lower layer 16 of contact material was treated, e.g. abraded, to define the two contacts 18 and 20, which are separated by the abraded gap 22.

The thermistor 10 is permanently installed on the somewhat flexible, thin, plastic substrate 30. Affixed to the upper surface of the substrate 30 are the two conductors 32 and 34 which extend from the thermistor to a remote location and to some means, such as a potentiometer, to which the thermistor is to be electrically connected. See U.S. Application Ser. No. 779,152. The conductors 32, 34 may be thin, foil layers of silver or the like conductive material. The substrate and conductor layers are, correspondingly to the illustrated thermistor, relatively small in size with relatively small dimensions.

It is relatively difficult to emplace the thermistor 10 at a precise position such that its bottom surface contacts 18 and 20 will be placed properly to engage the conductors 32 and 34. With small size thermistor 10, quite precise instrumentation is required for ensuring proper positioning and orientation of the thermistor 10. FIG. 1 illustrates a typical misorientation of the thermistor 10, wherein the square shaped thermistor is turned slightly from its preferred orientation. The twisting is unfortunately sufficient for the contact 20 to be simultaneously in contact with both of the conductors 32 and 34, which results in a short circuit across the thermistor 10 along the contact 20. Other slightly off-center positioning of the thermistor 10, twisting the same, or the like, will produce similar or related problems.

Figure 2:
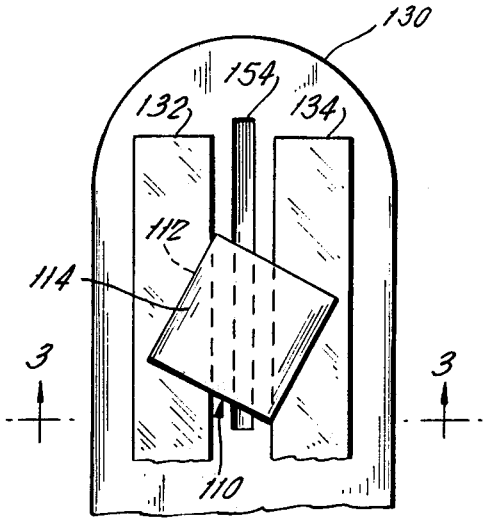
FIG. 2 is the same type of view as FIG. 1, but showing the same type of thermistor being treated according to one embodiment of the present invention.
Figure 3:
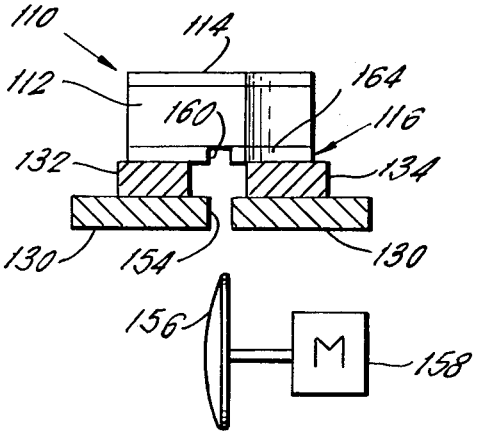
FIG. 3 is an end elevational view, partially in cross-section, of the thermistor and substrate assembly shown in FIG. 2 in combination with one abrading means.

Referring to FIGS. 2 and 3, one embodiment of the invention is now described. Elements in FIGS. 2 and 3 corresponding to those in FIG. 1 are correspondingly numbered with reference numerals raised by 100. They are not further described.

The thermistor 110 like the thermistor 10 initially comprised the body 112 of semiconductor material with a conductive layer 114 on its top surface and a layer 116 of conductive material on its bottom surface. Both of the layers 114 and 116 extend across the entirety of the respective opposite surfaces of the body 112. The thermistor 110 is placed on the substrate 130 with the layer 116 of contact material facing down. The thermistor is to be brought into electrical contact with the conductors 132 and 134, whereby it must be oriented at least to touch both of these conductors. So placing the small size thermistor 110 is much easier than not only properly placing but precisely orienting the thermistor 10 of FIG. 1. Once the thermistor 110 has been placed, it is secured in position on the conductors, for example by an adhesive, by tinning the conductors with the thermistor in place, by application of a covering sheath over the thermistor, or by other techniques, some of which are described in U.S. application Ser. No. 779,152.

Now that the thermistor 110 is in place, the single conductive contact material layer 116 must be treated to define separate contacts. In accordance with the invention, a gap or cut 154 has been made in and extends along the length of the substrate 130 between the conductors 132 and 134. The gap is made before the thermistor 110 is installed. Often the substrate 130 may be defined or cut from a continuous ribbon. At the time individual substrates are cut, their respective gaps may be cut. The gap 154 is longer than the length or width dimensions of the thermistor 110 and extends over the entire length of the section on the substrate 130 to which the thermistor might be applied in order for the apparatus, such as a thermometer, carrying the thermistor to operate properly. The width of the gap 154 is great enough that appropriate abrading, cutting, or trimming or other treatment means may extend or pass therethrough, thereby to trim the layer 150 of contact material.

The gap 154 is illustrated as being wholly enclosed within the periphery of substrate 130 and as not passing out to the edge thereof. The gap 154 may, as appropriate, be at any orientation with respect to the substrate 130 and may pass out to any peripheral edge thereof. The length and width of the gap vary as appropriate. It merely must be long enough and wide enough for the abrading, trimming or other treatment operation that is to be performed.

The thermistor is in position over the gap 154 with its layer 116 of contact material extending beyond both edges of the width dimension of the gap.

With the thermistor 110 held in place on the conductors 132 and 134, the abrading wheel 156, having an abrasive applied to its peripheral edge, is inserted from the side of the substrate away from the thermistor, through the gap 154, is passed between the conductors 132, 134 and is applied to the layer 116 of contact material to abrade the same away. The motor 158 rotates the wheel 156 for abrading. The wheel 156 is moved lengthwise along the gap 154, thereby abrading a gap 160 along the entire length of the thermistor 110 and there by defining for the first time separate contacts 162 and 164 from the single layer 116 of conductive material. The contacts are placed so that each contact 162 and 164 only engages the respective conductor 132 and 134, whereby no short circuit may develop. Precise orientation of the thermistor 110 on the conductors 132 and 134 when the theremistor is being mounted is not required.

Figure 4:
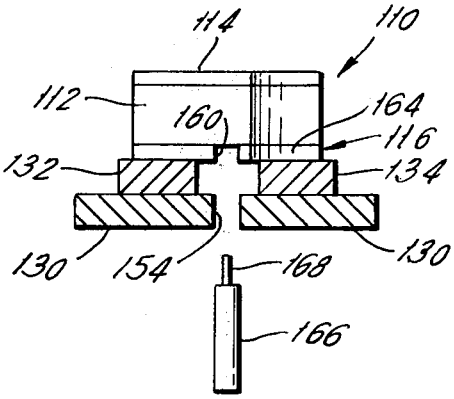
FIG. 4 is the same view as FIG. 3, showing another thermistor treatment means.

FIG. 4 differs from FIG. 3 only in that an alternate abrading or treatment apparatus is shown. A standard, carbon dioxide laser 166 directs a beam from its outlet 168 through the gap 154 toward the layer 116 of contact material, thereby defining the gap 160 in the same manner.

Figure 5:
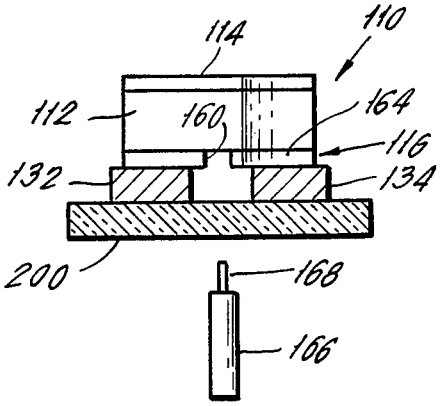
FIG. 5 is the same type of view as FIG. 4 showing another embodiment of the invention.

The second embodiment shown in FIG. 5 differs from FIG. 4 only in the character of the substrate. All elements in FIG. 5 are correspondingly numbered to those in FIG. 4, except for the substrate 200.

The substrate 200 has all of the above described characteristics of the substrate 130, with the addition that the substrate is clear or transparent for the transmission of the wavelength of electromagnetic radiation emitted by the laser 166. For example, the substrate may be completely clear for transmitting laser light. As the substrate will not interfere with the passage of laser light, a gap is no longer required in the substrate. Laser light is simply shone through the substrate along a path corresponding to the desired shape of the gap 160 in the layer 116 of contact material. In this way, the layer 116 is treated to define two contacts for the thermistor.

Although abrading a gap 160 to define two contacts on the thermistor is illustrated, it is possible to use the above-described method for trimming a contact, e.g. to change its rating, as described in U.S. application Ser. No. 787,422.

Although the thermistor 110 is shown as having a conductive layer 114 on its top surface, which is away from the conductors 132 and 134, the invention is adapted for use with a thermistor without such a conductive layer.

The invention is also adaptable for use with any other electrical component from which a layer of contact material, or the like, must be removed or otherwise treating the semiconductor body of a thermistor or other electrical component.

Although the present invention has been described in connection with preferred embodiments thereof, many variations and modifications will now become apparent to those skilled in the art. It is preferred, therefore, that the present invention be limited not by the specific disclosure herein, but only by the appended claims.

I claim:

1. A method of forming contacts on a surface of an electric component, comprising the steps of:

forming a through gap in a substrate;

providing an electric component having a layer of contact material extending over a surface thereof; applying the electric component to the substrate such that a portion of the surface of the layer of contact material is placed over the substrate gap, with the layer of contact material extending across the entire width of the gap;

operating through the gap, from the side of the substrate away from the electric component, removing the part of the layer of contact material over the gap from the electric component, thereby dividing the layer of contact material into two parts to form two separated contacts.

2. The method of forming contacts of claim 1, whrein the electric component is attached to the substrate before the part of the layer of contact material thereof is removed.

3. The method of forming contacts of claim 1, wherein the electric component is a thermistor.

4. The method of forming contacts of claim 1, wherein the substrate carries two spaced apart conductors; the gap in the substrate being formed between the conductors;

the applying of the electric component comprises placing the layer of contact material on and in electric contact with both of the conductors before the part of the layer of contact material is removed.

5. The method of forming electric contacts of claim 4, wherein the electric component is attached to the substrate before the part of the layer of contact material thereof is removed.

6. The method of forming electric contacts of claim 5, wherein the electric component is a thermistor.

7. The method of forming electric contacts of claim 6, comprising the further step of applying the layer of contact material over a surface of the thermistor prior to applying the thermistor to the substrate.

8. The method of forming contacts of claim 6, wherein the removing of the part of the layer of contact material is performed by abrading the layer through the gap.

9. The method of forming contacts of claim 6, wherein the removing of a part of the layer of contact material is accomplished by directing a beam of laser light through the gap against the layer of contact material along the length of the gap and passing the laser light over and removing the part of the layer of contact material above the gap on which the beam of laser light is directed.

10. The method of forming contacts of claim 1, wherein the removing of the part of the layer of contact material is performed by abrading the layer through the gap.

11. The method of forming contacts of claim 1, wherein the removing of a part of the layer of contact material is accomplished by directing a beam of laser light through the gap against the layer of contact material along the length of the gap and passing the laser light over and removing the part of the layer of contact material above the gap on which the beam of laser light is directed.

12. A method for removing at least part of a layer of material from an electric component, comprising the steps of:

forming a through gap in a substrate;

applying the electric component to the substrate such that a portion of the layer of material of the component to be removed is placed over the substrate gap;

operating through the gap, from the side of the substrate away from the electric component, removing a part of the layer of material from the side of the electric component facing toward the substrate.

13. The method for operating on a layer of material of claim 12, wherein the gap is formed before the electric component is applied to the substrate.

14. The method for operating on a layer of material of claim 13, wherein the electric component is attached to the substrate before the part of the layer thereof is removed.

15. The method for operating on a layer of material of claim 14, wherein the electric component is a thermistor and the layer of material comprises a layer of contact material on the thermistor.

16. A method for treating a layer of material of an electric component, comprising the steps of:

forming a through gap in a substrate;

applying the electric component to the substrate such that a portion of the layer of material of the component to be treated is placed over the substrate gap;

by operating through the gap from the side of the substrate away from the electric component, treating a part of the layer of material on the side of the electric component facing toward the substrate.

17. A method for removing at least part of a layer of material from an electric component, comprising the steps of;

providing a substrate having a section thereof at which the electric component is to be positioned; and the section of the substrate having the characteristic that it transmits through the substrate at least a particular wavelength of electromagnetic radiation that can be supplied by a laser;

applying the electric component to the substrate such that a portion of the layer of material of the component to be removed overlies the section of the substrate;

then directing a beam of laser light of a wavelength which the section of the substrate is able to transmit from the side of the substrate away from the electric component, through the substrate and onto the side of the electric component facing toward the substrate, and passing the laser light over and removing the part of the layer of material on which the laser light is directed.

18. The method for removing of claim 17, wherein at least the section of the substrate is comprised of a material that is capable of transmitting through itself electromagnetic radiation of the particular wavelength; the laser light being of the particular wavelength.

19. The method for removing of claim 18, wherein the section of the substrate is clear and transparent.

20. The method for removing of claims 17 or 18, wherein the electric component is a thermistor.

21. The method for removing of claims 17 or 18, wherein the substrate carries two spaced apart conductors; the applying of the electric component comprises placing the layer of material on and in electric contact with both of the conductors; the laser light being shone on the layer of material between the conductors.

22. The method for removing of claim 21, wherein the electric component layer comprises a layer of contact material.

23. A method for removing at least part of a layer of material from an electric component, comprising the steps of:

providing a substrate having a section thereof at which the electric component is to be positioned; the section of the substrate having a gap defined therethrough;

applying the electric component to the substrate such that a portion of the layer of material of the component to be removed overlies the section of the substrate and the gap therethrough;

then directing a beam of laser light from the side of the substrate away from the electric component, through the gap in the substrate and onto the side of the electric component facing toward the substrate, and passing the laser light over and removing the part of the layer of material on which the laser light is directed.

* * * * *